US006274231B1

(12) United States Patent
Weerkamp

(10) Patent No.: US 6,274,231 B1
(45) Date of Patent: Aug. 14, 2001

(54) SUPPORT WITH SUPER-ABSORBENT MATERIAL, METHOD FOR THE PREPARATION THEREOF AND USE

(75) Inventor: Louis Leonard Weerkamp, Enschede (NL)

(73) Assignee: Blydenstein-Willink N.V. (NL)

( * ) Notice: Subject to any disclaimer, the term of this patent is extended or adjusted under 35 U.S.C. 154(b) by 0 days.

(21) Appl. No.: 09/242,353

(22) PCT Filed: Aug. 25, 1997

(86) PCT No.: PCT/NL97/00480

§ 371 Date: Dec. 7, 1999

§ 102(e) Date: Dec. 7, 1999

(87) PCT Pub. No.: WO98/07775

PCT Pub. Date: Feb. 26, 1998

(30) Foreign Application Priority Data

Aug. 23, 1996 (NL) ..... 1003867
Sep. 20, 1996 (NL) ..... 1004087

(51) Int. Cl.[7] ..... B32B 3/26

(52) U.S. Cl. ..... 428/304.4; 521/50; 521/50.5; 521/56; 521/57; 427/180; 427/249; 427/288; 427/373; 427/487; 427/501; 427/505; 427/532; 428/308.4; 428/402

(58) Field of Search ..... 521/50, 50.5, 56, 521/57; 427/487, 501, 505, 532, 180, 245, 288, 373; 428/304.4, 308.4, 402

(56) References Cited

U.S. PATENT DOCUMENTS 3,615,972 10/1971 Morehouse et al. ..... 156/79
4,006,273 2/1977 Wolinski et al. ..... 427/278

FOREIGN PATENT DOCUMENTS

WO9623024 1/1996 (WO) .

OTHER PUBLICATIONS

"Nützliches Videosystem am Stapler", Hebezeuge und Fördermittel, Berlin 35(1995)b.

*Primary Examiner*—Samuel A. Acquah
(74) *Attorney, Agent, or Firm*—Webb Ziesenheim Logsdon Orkin & Hanson, P.C.

(57) ABSTRACT

The invention relates to a support provided with super-absorbent material to be manufactured by causing suitable monomers to polymerize in the presence of a catalyst in order to obtain a polymer solution, adding a cross-linking agent to the polymer solution to obtain a pasty composition, subsequently applying the composition on or in a support and allowing the applied composition to dry and cross-link in order to obtain the support with the super-absorbent material, wherein microspheres are added to the paste.

12 Claims, No Drawings

SUPPORT WITH SUPER-ABSORBENT MATERIAL, METHOD FOR THE PREPARATION THEREOF AND USE

BACKGROUND OF THE INVENTION

1. Field of the Invention

The present invention relates to a support provided with a super-absorbent material, to a method for preparation thereof, a method for manufacturing the super-absorbent material, in addition to the use of the support in different products.

2. Description of the Related Art

Such a super-absorbent material is described in NL-A-1000572. With the "swelling coating" described in this patent application is proven that a paste, which after drying and curing has super-absorbent properties, is applied most effectively (i.e. with the best absorption properties) via a template application technique. Using this printing technique the islets of paste are applied such that after drying and curing they have a diameter of 200 $\mu$. A second advantage of application in this manner is that release of the coating is prevented. Because the used polymer is very hard, full surface coating is not possible therewith since after drying the coating as it were breaks off the substrate. Even after application of the coating in the form of islets, these will still sometimes "break off". A drawback to the application technique, and therefore the form of the coating, is that the application is limited. It is theoretically possible to apply a maximum such that the islets of 200 $\mu$ are 200 $\mu$ from each other and, if they are completely (semi-) spherical, are a maximum of 100 $\mu$ high. Theoretically therefore, application will be a maximum of 70 g/m$^2$. This application is however less because the applied coating contains 70% water and the dot therefore also shrinks. Nor is the applied dot ideally semi-spherical, whereby it is very difficult in practice to apply more than 50 g/m$^2$ (dry).

In the first instance a possibility was sought of making the coating softer so that after application it is no longer so hard that the coating "breaks off" at the slightest mechanical load.

Research has been carried out into two types of softener; a softener between the polymer and a softener which is "fixed" to the polymers. In addition to the first type of softener not being recommended in the case of a cable sheathing material (corrosion of the insulation), it has also been found not to work, the coating remained brittle.

SUMMARY OF THE INVENTION

The invention has for its object to obviate the above stated drawbacks and provides for this purpose a method which is distinguished in that expanded microspheres are added to the coating.

DETAILED DESCRIPTION OF THE PREFERRED EMBODIMENT

It has been found by chance that, by adding expanded microspheres, not only did the coating become much less hard, but also that these microspheres had a positive effect on the so-called swelling speed (=absorption time).

These two properties discovered by chance now make possible full surface application of the paste on a number of substrates while still retaining the same absorption properties.

That the absorption properties become better can be explained by the fact that the coating layer becomes microporous due to the presence of the microspheres and the water transports rapidly through the coating.

It can be established experimentally that addition of 1–100%, preferably 10% microspheres makes the coating softer and swelling sheathing material can thereby be applied in full surface coating to the same substrates as described in the above stated patent application, whereby the application can also be increased (more than 50 g/m$^2$ dry).

In this application "microspheres" are understood to mean small globules which are filled with gas. Through heating the gas expands and the globules increase in size. Microspheres are per se known and are used for different purposes, such as filler in inks etc.

A known type of microsphere, which is also particularly suitable for use in the invention, are microspheres of the brand and type Expancel™ 551 WE. The wall of microspheres generally consists of a thermoplastic polymer.

For use in the invention the microspheres may or may not be expanded. Expansion can take place prior to or during the production process of the coating.

What is claimed is:

1. A method for preparing a microporous full surface superabsorbent polymer coating comprising adding a cross-linking agent to a polymer solution, adding gas-filled polymeric microspheres to the polymer solution prior to, during or after the addition of the cross-linking agent and applying the coating as a paste to a support.

2. The method as claimed in claim 1, wherein the microspheres are expanded.

3. The method as claimed in claim 2, wherein the microspheres are expanded by heating.

4. The method as claimed in claim 3, wherein the microspheres are expanded by heating prior to adding the microspheres to the polymer solution.

5. The method as claimed in claim 3, wherein the microspheres are expanded by heating after adding the microspheres to the polymer solution.

6. A microporous full surface superabsorbent polymer coating comprising a cross-linked polymer and gas-filled polymeric microspheres.

7. The polymer coating as claimed in claim 6, wherein the microspheres are expanded.

8. A microporous full surface superabsorbent polymeric coating prepared according to the steps of adding a cross-linking agent to a polymer solution and adding gas-filled polymeric microspheres to the polymer solution prior to, during or after the addition of the cross-linking agent.

9. The microporous polymeric coating as claimed in claim 8, wherein the microspheres are expanded.

10. The microporous polymeric coating as claimed in claim 9, wherein the microspheres are expanded by heating.

11. The microporous polymeric coating as claimed in claim 10, wherein the microspheres are expanded by heating prior to adding the microspheres to the polymer solution.

12. The microporous polymeric coating as claimed in claim 10, wherein the microspheres are expanded after adding the microspheres to the polymer solution.

* * * * *

UNITED STATES PATENT AND TRADEMARK OFFICE

CERTIFICATE OF CORRECTION

PATENT NO. : 6,274,231 B1
DATED : August 14, 2001
INVENTOR(S) : Louis Leonard Weerkamp It is certified that error appears in the above-identified patent and that said Letters Patent is hereby corrected as shown below:

Title page,
Item [73], Assignee, delete "Blydenstein-Willink N.V. (NL)" and insert -- Stockhausen GmbH & Co., KG (DE) --.

Signed and Sealed this

Twenty-fifth Day of December, 2001

*Attest:*

*Attesting Officer*

JAMES E. ROGAN
*Director of the United States Patent and Trademark Office*